United States Patent [19]

Yin

[11] Patent Number: 4,791,250

[45] Date of Patent: Dec. 13, 1988

[54] TRIP-FREE, THREE-LINK SWITCH ASSEMBLY

[75] Inventor: Simon Yin, Fremont, Calif.

[73] Assignee: Square D Company, Palatine, Ill.

[21] Appl. No.: 82,442

[22] Filed: Aug. 6, 1987

[51] Int. Cl.[4] ..... H01H 3/00

[52] U.S. Cl. ..... 200/17 R; 200/153 SC; 335/189; 335/172

[58] Field of Search ..... 200/17 R, 18, 50 C, 200/144 B, 153 H, 153 SC, 337; 335/8–10, 20, 24, 76, 165, 166, 172, 174, 189, 190; 337/74

[56] References Cited

U.S. PATENT DOCUMENTS

| | | | |
|---|---|---|---|
| 3,457,531 | 7/1969 | Goodwin, Jr. | 335/174 X |
| 4,591,678 | 5/1986 | Yin | 200/144 B |
| 4,591,679 | 5/1986 | Yamat et al. | 200/144 B |

*Primary Examiner*—J. R. Scott

*Attorney, Agent, or Firm*—Flehr, Hohbach, Test, Albritton & Herbert

[57] ABSTRACT

A switch assembly especially suitable for use as part of an overall electrical circuit breaker is disclosed herein. This switch assembly includes a three-link arrangement consisting of three links interconnected together for movement between a first positional configuration in order to open a circuit and a second positional configuration in order to close and circuit. A mechanism is provided for applying a force to the linkage arrangement in a way which causes the links to open from a closed position, that is, to move from their first positional configuration to their second positional configuration, and thereafter for maintaining the links in their open configuration. An arrangement separate from the force-applying mechanism and including one of the three links is also provided for automatically overriding the application of force to the three-link arrangement in order to cause the links to immediately move back to their opened configuration, either during movement to their closed configuration, or after the links have been closed by the force-applying mechanism. In other words, the switch disclosed herein can be tripped back to its open position at any time.

6 Claims, 9 Drawing Sheets

TRIP-FREE, THREE-LINK SWITCH ASSEMBLY

BACKGROUND OF THE INVENTION

The present invention relates generally to switch assemblies and more particularly to a switch assembly especially suitable for use as part of a high voltage circuit breaker.

Circuit breakers generally are well-known in the art. In those situations where they are intended for use in high and ultra-high voltage circuits, for example on the order of 15,000 volts, it is essential that the breaker itself be trip-free in any position. That is, whether the breaker is closed or moving to its closed position, it is essential that an operator be able to override the closing mechanism at any time and cause the breaker to open immediately. In order to meet this objective, one typical type of high voltage circuit breaker utilizes a series of interconnected links which, in turn, are connected to breaker contacts for opening and closing the latter as the links move between a first, open positional configuration and a second, closed configuration.

While it has been found to be highly desirable to design high voltage circuit breakers utilizing an arrangement of links, because of the override requirements discussed above, the typical link arrangements have been relatively complicated, requiring at least four links in order to provide override capabilities. An example of this is illustrated schematically in FIGS. 1A, 1B and 1C. The overall circuit breaker shown there is generally indicated by the reference numeral 10 and includes a fixed contact 12 and a movable contact 14, both of which are adapted for connection into a high voltage circuit for opening and closing the latter. Circuit breaker 10 also includes a switch assembly 16 which will be described in more detail immediately below. For the moment it suffices to say that assembly 16 is connected to movable contact 14 through suitable means such as a connecting bar 18 in order to move contact 14 between its opened, solid line position spaced from contact 12 and its closed, dotted line position directly against contact 12.

Referring specifically to FIG. 1A, switch assembly 16 is shown including a four-link arrangement consisting of links 20, 22, 24 and 26. Link 20 is itself mounted for pivotal movement by suitable pivot means 27 and is also pivotally connected at one end to connecting bar 18 and at its other end to one end of link 22. The opposite end of link 22 is pivotally connected to one end of link 24 which has its opposite end pivotally connected to link 26. The four links are shown in FIG. 1A in a positional configuration in which the contact 14 is just beginning to move from its opened position downward to its closed position. Note that the free end of link 26 rests against the movable latch or stop 28. Link 26 is biased in this position by suitable means such as spring 29 which applies force F1 onto the link, as shown. In actuality, the spring is intended only to diagrammatically represent a suitable means for providing that biasing force onto the link so that the latter remains in the position illustrated so long as the latch remains in the position shown. At the same time, a cam member 30 or any other suitable means is provided for applying an upward force F2 against the bottom end of link 22, as shown in FIG. 1. In the case of cam member 30, the upward force F2 can be provided by rotating the cam member clockwise, as indicated by arrow 32.

Still referring to FIG. 1A, the application of force F2 onto the underside of link 22 in the manner shown causes the link to move upward, as indicated by arrow 34. This, in turn, causes the left end of link 24 to pivot upward, as indicated by arrow 36 and the left end of link 20 to pivot downward about pivot point 27, as indicated by arrow 38. This latter movement, in turn, causes the interconnecting link 18 to move downward, as indicated by arrow 40, thereby causing contact 14 to move into engagement with contact 12.

It is important to note that during the various movements of links 20, 22 and 24 described immediately above, link 26 remained stationary, biased against latch 28 by biasing force F1. In the case of circuit breaker 10, so long as link 26 remains in that position, cam member 30 can be rotated between extreme positions in order to apply and remove force F2 in order to cause the arrangement of links 20, 22 and 24 to move between the positional configuration illustrated in FIG. 1A for opening contacts 12 and 14 and the positional configuration shown in FIG. 1B for closing the contacts.

Referring specifically to FIG. 1B in conjunction with 1C, it will now be shown how link 26, the fourth link in the overall arrangement of links, is used as an override to cause the contacts 12 and 14 to open immediately regardless of the positional configuration of the other three links. As indicated above, link 26 is normally biased against latch 28. By rotating the latch clockwise or counterclockwise it is taken out of the path of movement of link 26, thereby allowing force F1 (see FIG. 1A) to immediately cause the link to pivot about a support point 41, as indicated by arrow 42. This causes the left-hand end of the link, as viewed in FIG. 1B, to pivot upward and to the right as indicated by arrow 44 and its right end to pivot downward and to the left as indicated by arrow 46. This in turn causes the joining point between links 22 and 24 to pivot upward and to the left, as indicated by arrow 48 while the joining point between links 20 and 22 pivot downward, as indicated by the arrow 50. These various movements ultimately cause the left-hand end of link 20 to pivot upward and to the right, as indicated by arrow 52, thereby pulling contact 14 forward and away from contact 12, as illustrated in FIG. 1C. It is important to note from FIG. 1C that these various movements cause the link 22 and all other links making up the overall arrangement to move away from force-applying cam member 30 so that the latter has no further effect on the arrangement. In other words, it is not necessary to take positive steps in removing the force F2 in order to "trip" the system and override the force in order to immediately open the contacts. It merely requires moving the link 26 in the manner illustrated.

The foregoing has been a description of a prior art type of circuit breaker utilizing four links to provide immediate override capabilities in order to open the breakers at any time during its operation. It is to be understood that only those components of the overall circuit breaker pertinent to the present discussion have been illustrated. Other components including, for example, the various support structure, have been omitted for purposes of clarity. While this particular design appears to function in a satisfactory manner to provide the desired override capabilities, it does require four links which makes a relatively complicated device from a structural standpoint. Nevertheless, applicant is not aware of any heretofore available link-type circuit breakers which do not utilize at least four links in order to provide desired override capabilities.

SUMMARY OF THE INVENTION

In view of the foregoing, it is an object of the present invention to provide a switch arrangement generally and a circuit breaker in particular which utilizes a relatively uncomplicated and reliable structural configuration for opening and closing electrical contacts or other such means.

A more particular object of the present invention is to provide a switch assembly which utilizes a link arrangement of the general type described above, but one which is able to provide override capabilities with only three links, rather than four or more.

As will be described hereinafter, the switch assembly disclosed herein is one which includes a three-link arrangement consisting of three links interconnected for movement between a first, opened configuration and a second, closed configuration. The assembly also includes means for applying a force to the link arrangement in a way which causes the links to move from their first positional configuration to their second positional configuration and which maintains the links in this latter positional configuration. In accordance with the present invention, the switch assembly includes means separate from the force-applying means and including one of the three links for automatically overriding the application of force to the arrangement in order to cause the links to move immediately back to their first positional configuration, that is the opened configuration, even if the links are in the process of moving toward their second positional configuration or after they have reached their second positional configuration.

BRIEF DESCRIPTION OF THE DRAWINGS

The three-link switch assembly just described is especially suitable for use as part of an overall high voltage circuit breaker, as will be described in more detail hereinafter in conjunction with the drawings wherein.

DESCRIPTION OF THE PREFERRED EMBODIMENT

Figure 1A:
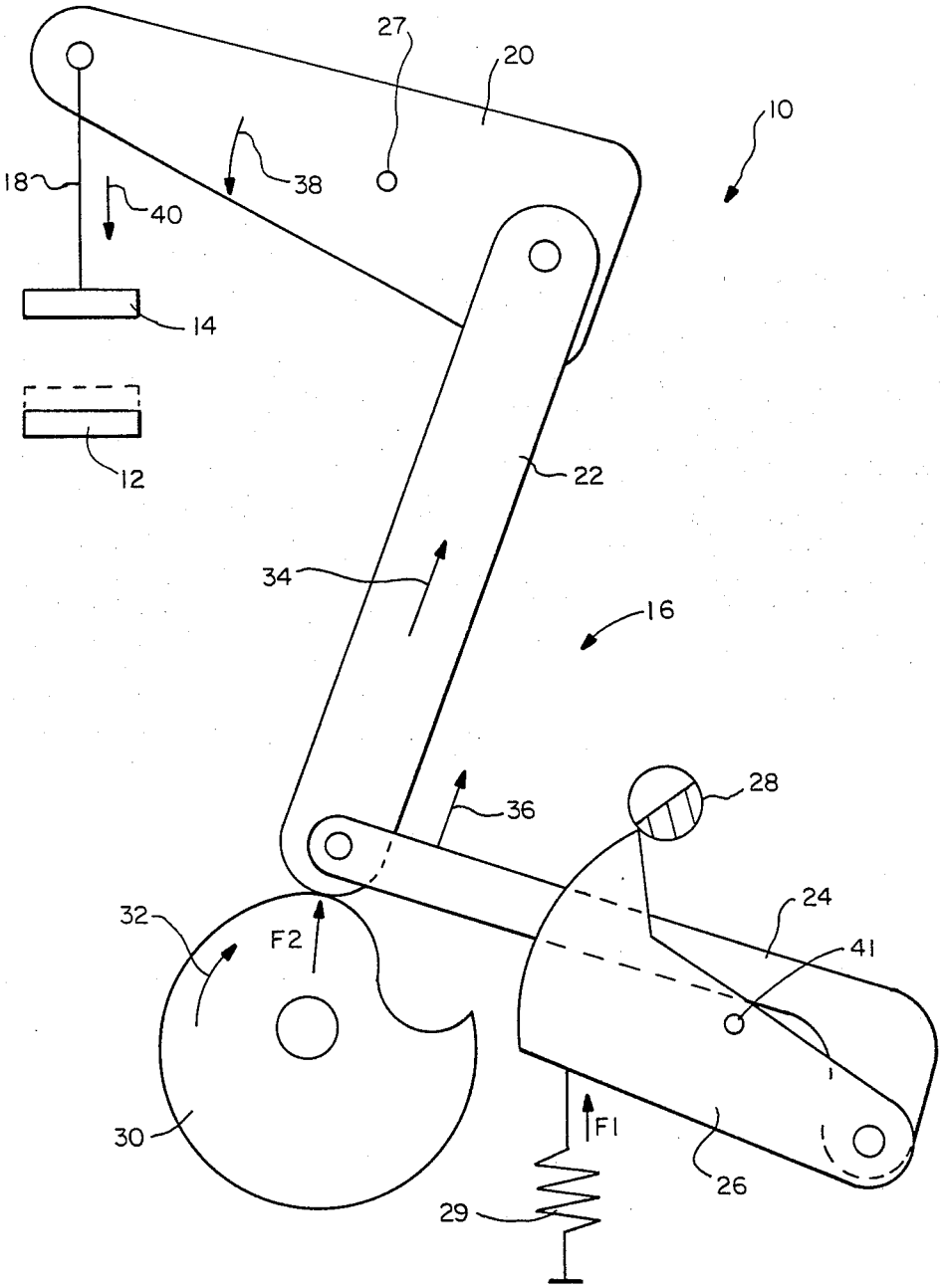
PRIOR ART FIG. 1A
FIG. 1A is a diagrammatic illustration, in plan view, of a four-link type of circuit breaker designed in accordance with the prior art and shown in a specific operating condition.
Figure 1B:
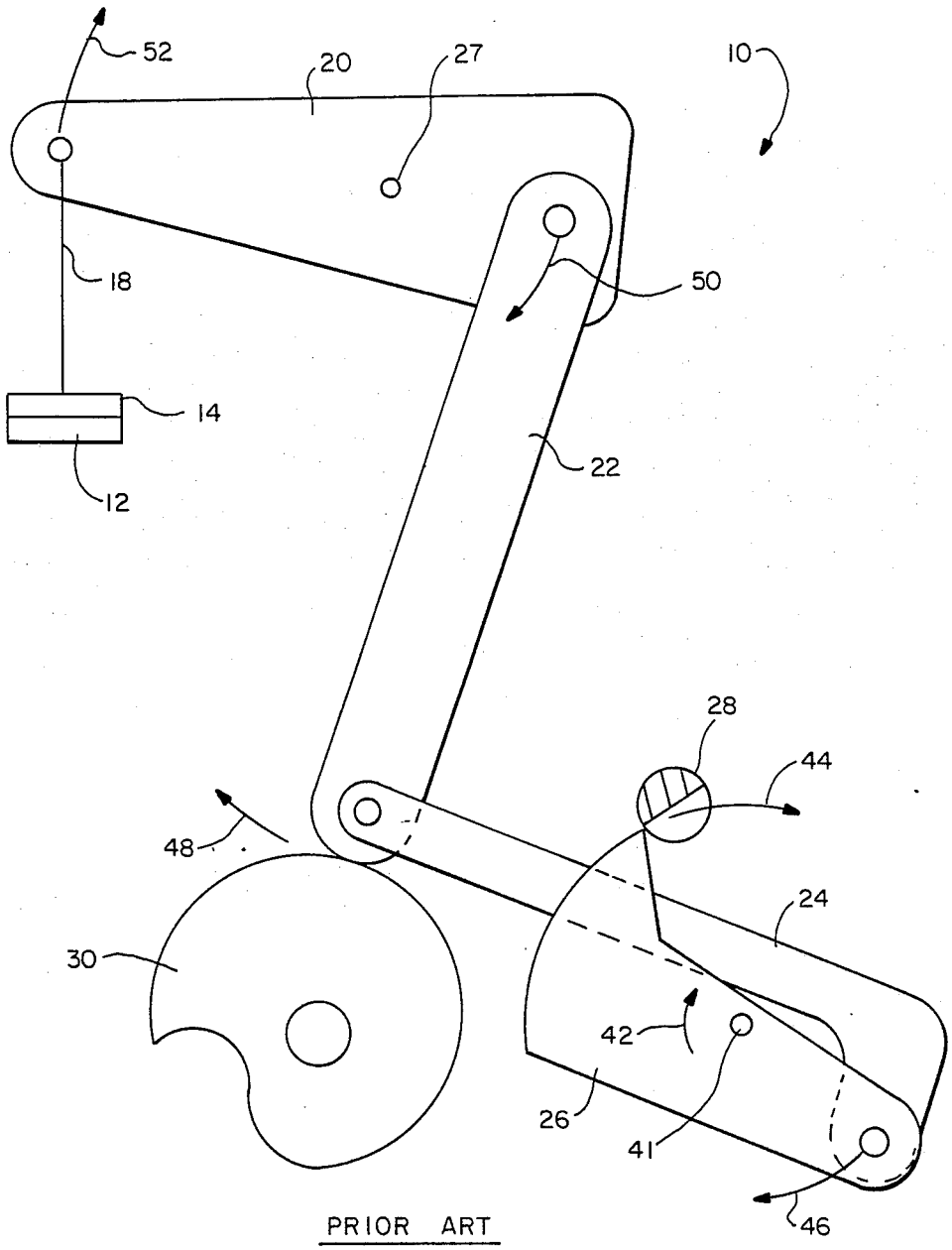
FIGS. 1B and 1C are diagrammatic illustrations, in plan view, showing the circuit breaker of FIG. 1A in different operating conditions.
Figure 1C:
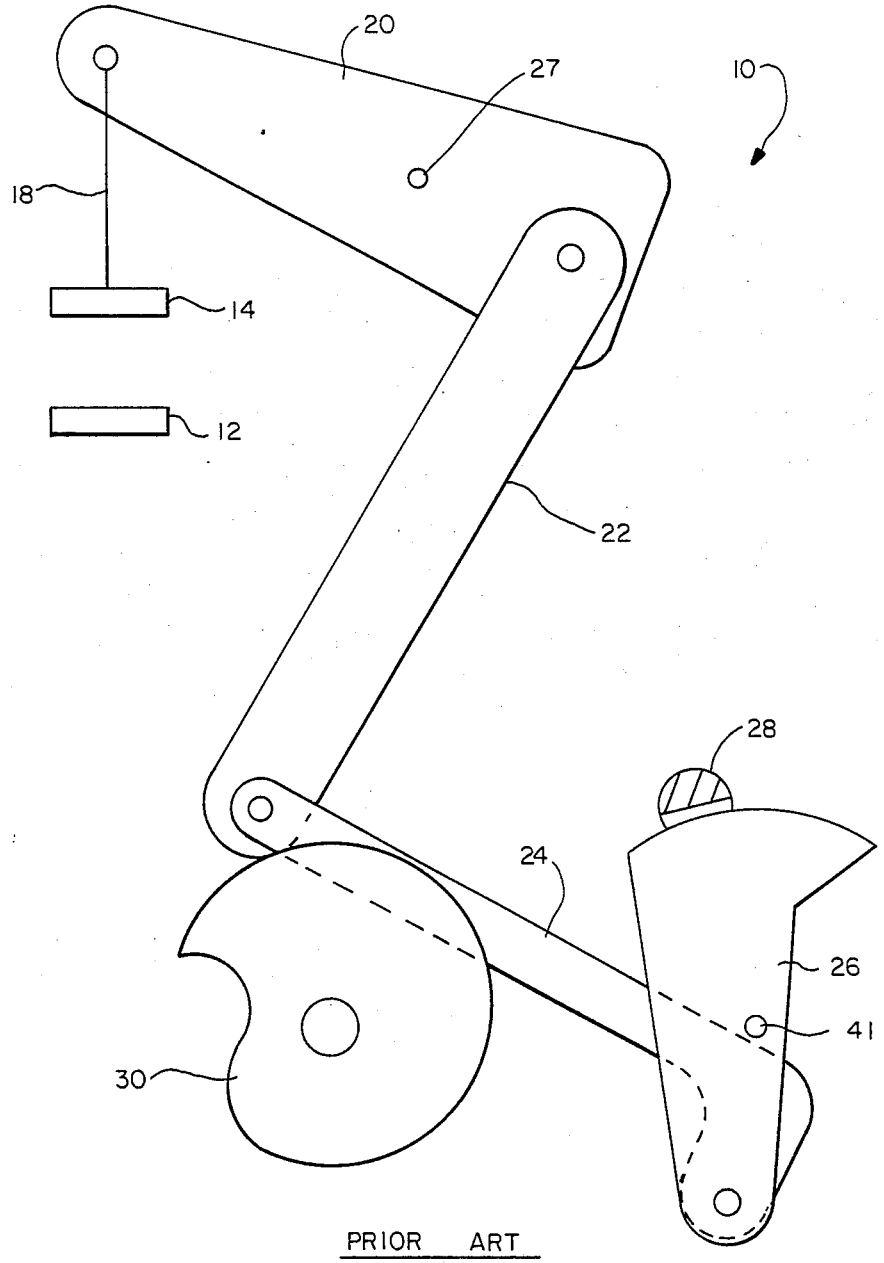
Figure 2A:
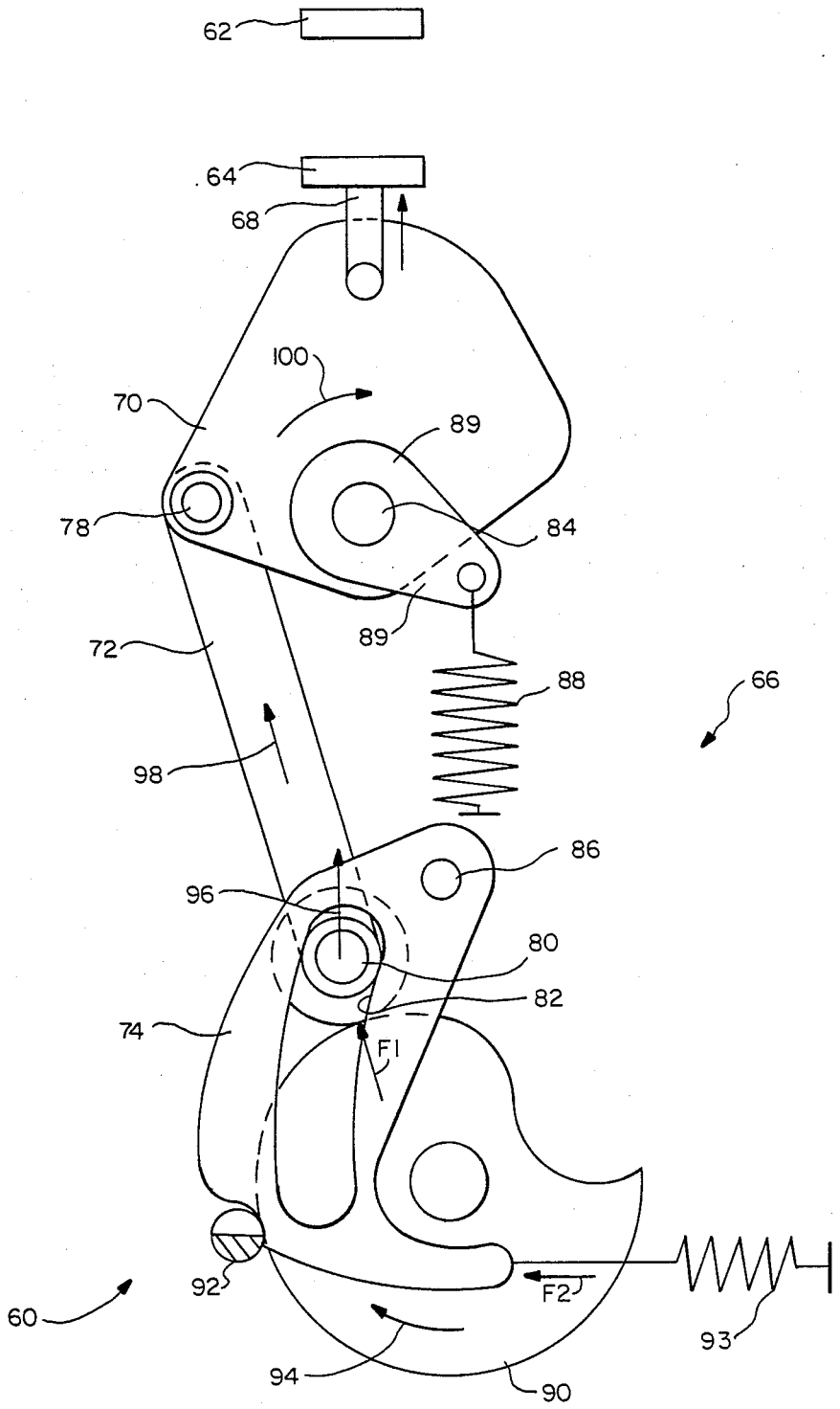
FIG. 2A is a diagrammatic illustration, in plan view, of a circuit breaker assembly designed in accordance with the present invention and shown in a particular operating condition.

Inasmuch as FIGS. 1A–1C have been described previously, attention is immediately directed to FIGS. 2A–2C which, as stated previously, diagrammatically illustrate a circuit breaker designed in accordance with the present invention. Referring specifically to FIG. 2A, the overall circuit breaker is generally indicated by the reference numeral 60 and it is shown including a fixed electrical contact 62 and a contact 64 movable between its opened, solid line position spaced from contact 62 and a closed position against contact 62, as indicated by dotted lines.

The circuit breaker also includes a switch assembly 66 connected to contact 64 by suitable means diagrammatically represented by pivotally connected bar or other suitable coupling 68 for moving contact 64 between its opened and closed position. As will be seen below, switch 66 is designed to provide the previously described override capabilities so that the circuit breaker can be opened at any time. Moreover, as will also be seen, this is accomplished utilizing an uncomplicated three-link arrangement rather than the four-link arrangement typically utilized in the prior art.

As illustrated in FIG. 2A, switch assembly 66 includes a three-link arrangement consisting of links 70, 72 and 74. Link 70 is pivotally connected to one end of link 72 by suitable pivot means generally indicated at 78. The opposite end of link 72 is coupled to link 74 by means of a cam roller 80 which rides within a cooperating slot 82 in link 74. Both links 70 and 74 are also pivotally connected to suitable support components (not shown) of the circuit breaker by suitable pivot means generally indicated at 84 and 86, respectively. In addition, for reasons to be described hereinafter, link 70 is connected to what will be referred to as an opening spring 88 to be described hereinafter by connector 89 and link 74 is biased against a movable latch or stop 92 by forces diagrammatically illustrated at F2, as represented by spring 93.

Figure 2B:
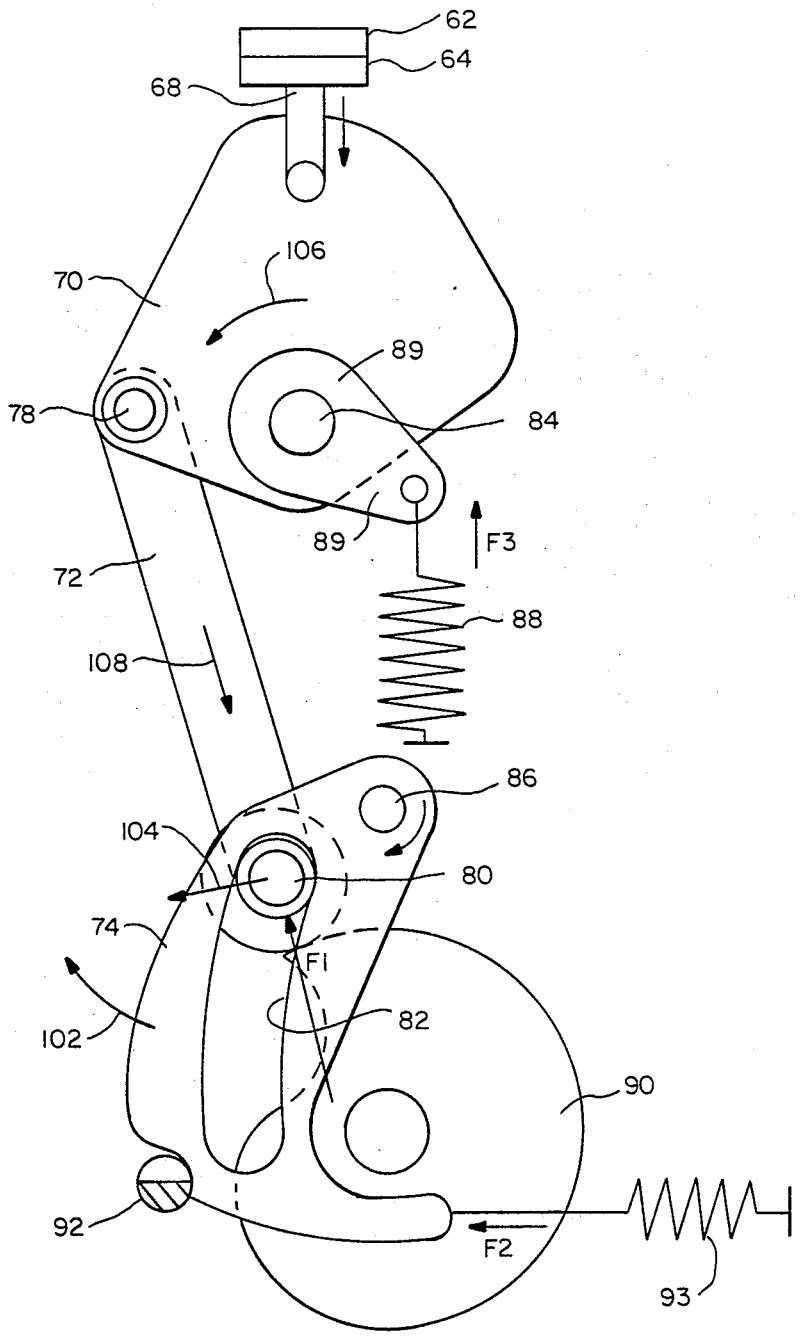
FIGS. 2B and 2C are diagrammatic illustrations, in plan view, of the circuit breaker of FIG. 2A, shown in different operating conditions.

Having described the arrangement of links 70, 72 and 74 and certain associated components, attention is now directed to the way in which the switch assembly moves contact 64 from it opened position shown in FIG. 2A to its closed position which is shown in FIG. 2B. To this end, the switch assembly includes a rotatable cam member 90 and means to be described with respect to FIGS. 3 and 4 for rotating the cam member in the direction of arrow 94. So long as link 74 remains fixed in the position illustrated in FIG. 2A, that is, engaged against latch 92, cam member 90 will continuously engage the bottom end of link 72, actually the cam roller 80 which forms part of link 72 at its bottom end. As the cam member 90 rotates in the direction of arrow 94, it applies an upward force F1 to the cam roller 80 causing the latter to move upward while constrained within slot 82, as indicated by arrow 96. This, in turn, causes link 72 to move upward, as indicated by arrow 98, thereby causing link 70 to pivot clockwise about pivot means 84, as indicated by arrow 100. This action of link 70 causes contact 64 to close against contact 62, as illustrated in FIG. 2. At the same time, as illustrated in this latter figure, the clockwise rotation of link 70 compresses the spring 88 causing the latter to apply its own compression force F3 against the link, as seen in FIG. 2B. However, so long as the force F1 from cam member 90 is applied in the manner illustrated in FIG. 2B, the contacts 62 and 64 will remain closed.

Figure 2C:
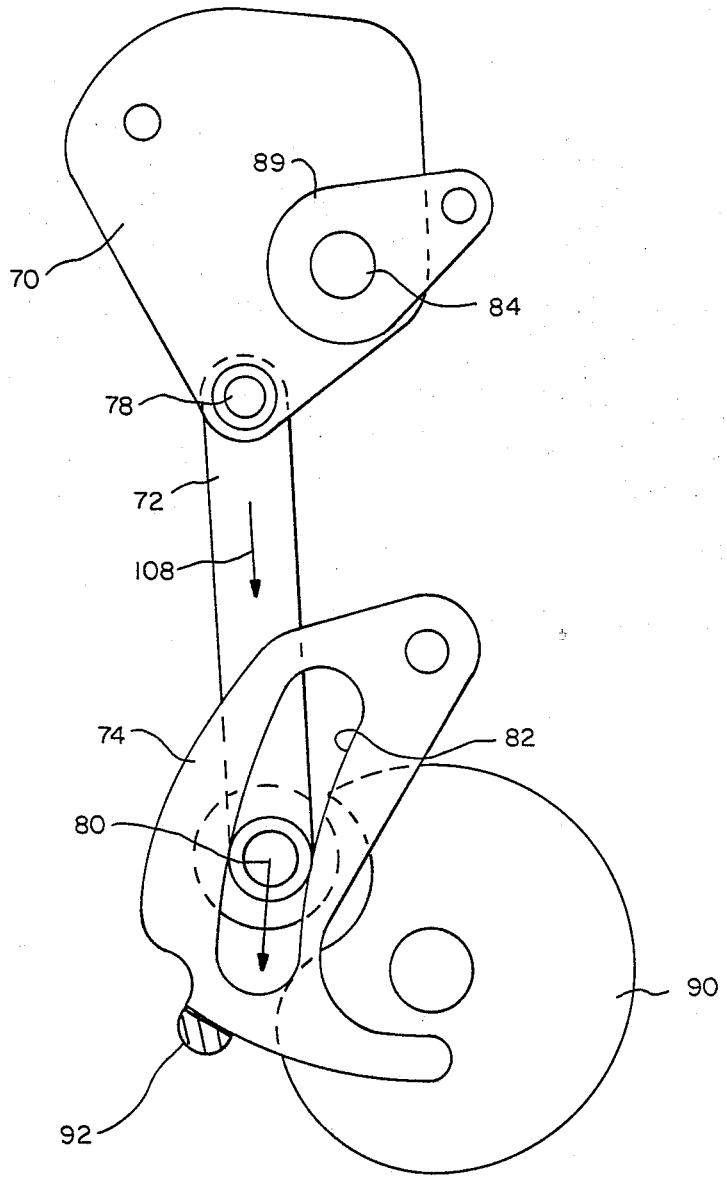

Referring now to FIG. 2C in conjunction with FIG. 2B, attention is directed to the way in which switch assembly 66 operates with only three links to open contacts 62 and 64 regardless of the positional configuration of the links, that is, whether or not the links are in the closed positional configuration illustrated in FIG. 2B or en route to that positional configuration from the opened positional configuration illustrated in FIG. 2A. To this end, it should be recalled that link 74 remains stationary in a biased position against latch 92 during the entire time that the links 70 and 72 were moved from the opened contact configuration of FIG. 2A to the closed contact configuration of FIG. 2B. If at any point in time during this latter movement, latch 92 is rotated from the position shown in FIG. 2A to the position shown in FIG. 2C, link 74 is allowed to move in its biased direction past the lever, as indicated by arrow 102 in FIG. 2B. This automatically pulls cam roller 80 to the left, as indicated by arrow 104 in FIG. 2B, and off of cam member 90. As a result, the force F3 from opening spring 88 causes link 70 to pivot counterclockwise about pivot means 84, as indicated by arrow 106. This, in turn, moves link 72 and cam roller 80 further downward, as indicated by arrows 108 and 110 in FIG. 2C. This entire motion pulls contact 64 away from contact 62.

From the action just described, note in FIG. 2C that cam member 90 no longer engages either link 72 directly or its cam roller 80. In other words, by releasing latch 92, the link 74 itself is used as part of an overall mechanism for disengaging the three-link arrangement from force-applying cam member 90 in order to open contact 62 and 64. Stated another way, at any point in the operation of circuit breaker 60 the contacts can be made to immediately open utilizing the three-link arrangement instead of the four-link configuration typical in the prior art and diagrammatically illustrated in FIGS. 1A–1C. This is possible because of the utilization of one of the links, specifically link 74, as the tripping link.

Figure 3:
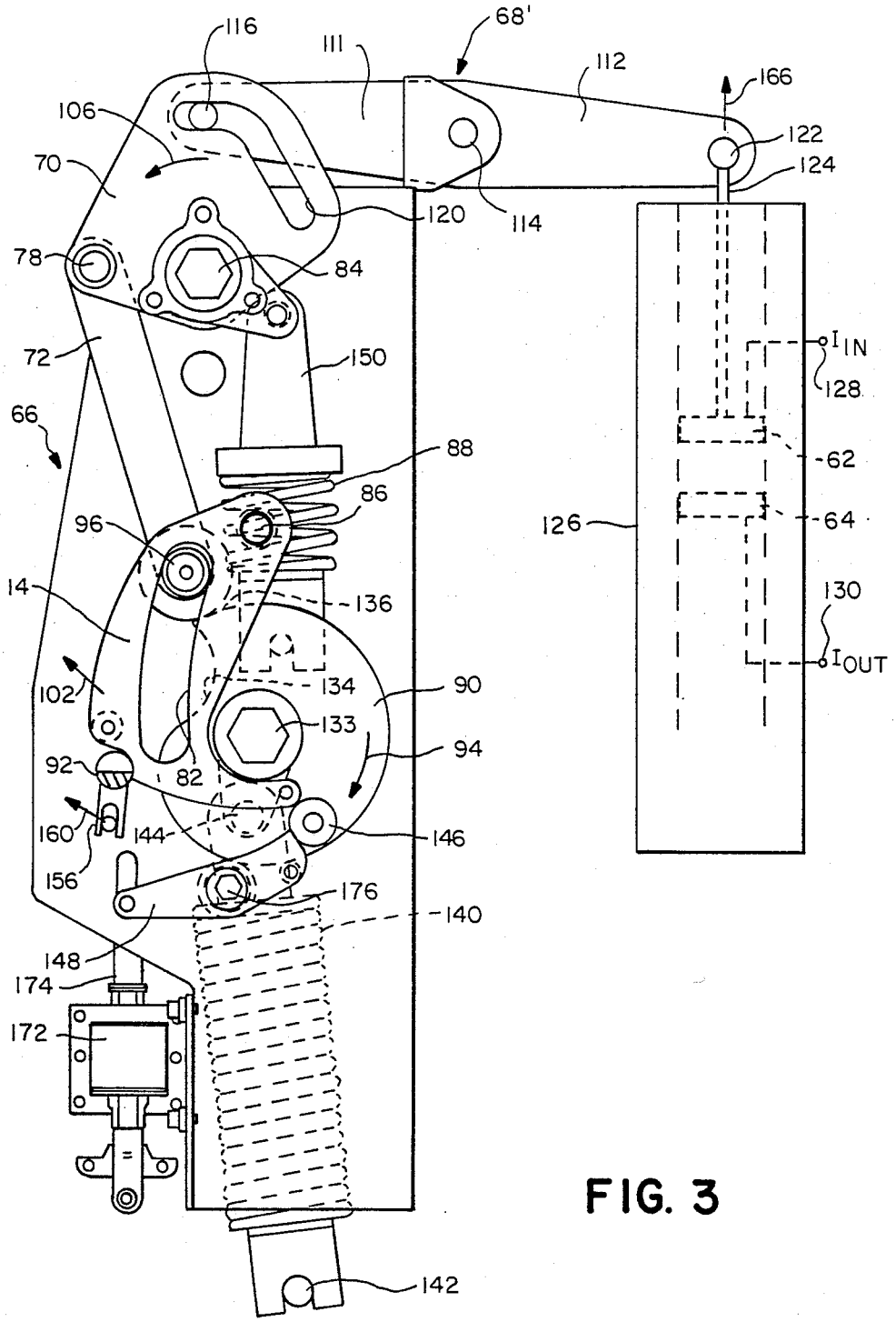
FIG. 3 is a side elevational view of an actual working embodiment of the circuit breaker shown in FIGS. 2A–2C, with the circuit breaker being shown in its closed state.
Figure 4:
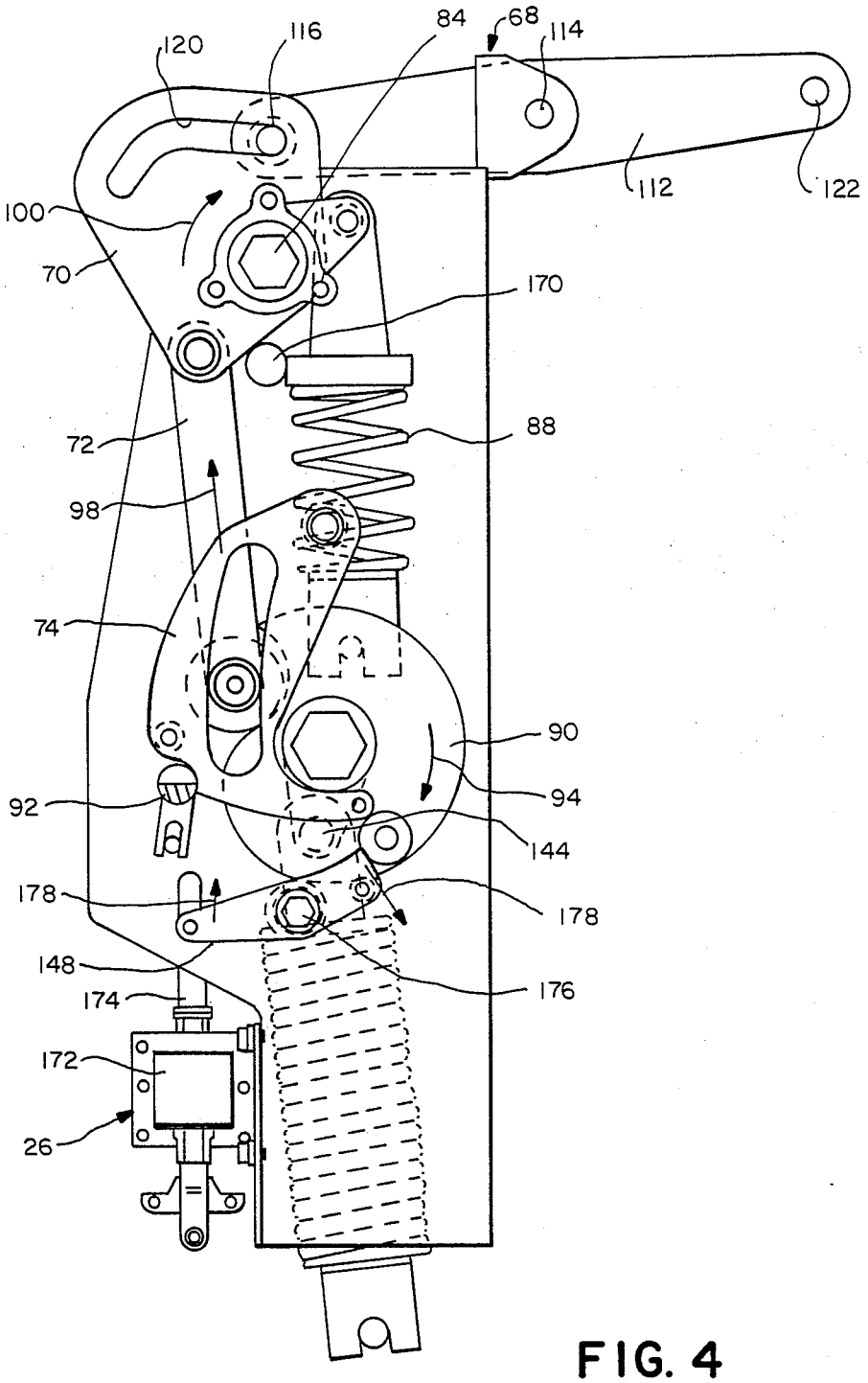
FIG. 4 is a view similar to FIG. 3 but showing the circuit breaker in its opened state.
Figure 5:
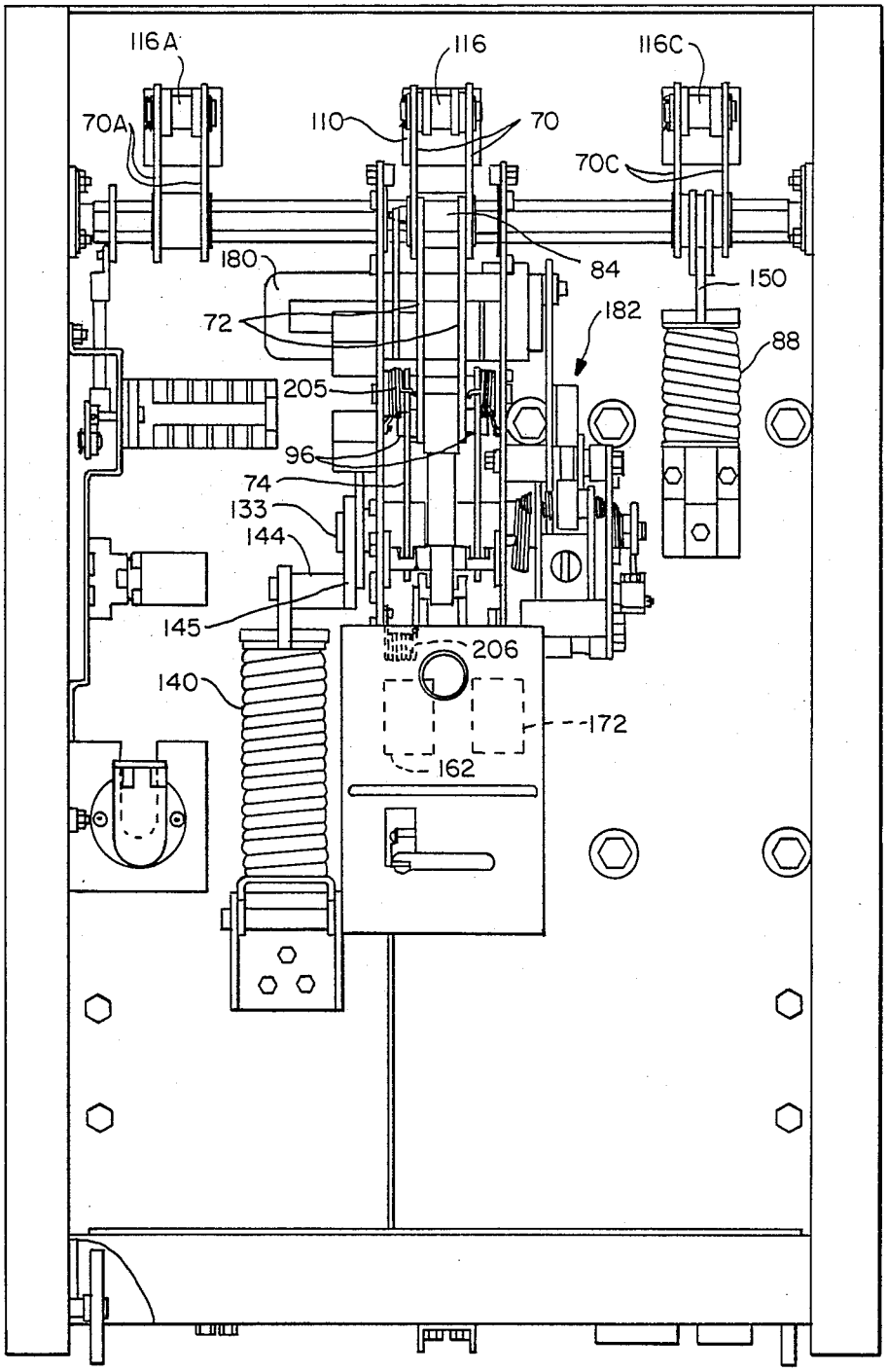
FIG. 5 is a side elevational view of the overall circuit breaker and certain related components.

Turning now to FIGS. 3 and 4, attention is directed to an actual working embodiment of the present invention. However, for purposes of convenience, like components in FIGS. 2A–2C, 3 and 4 (as well as FIG. 5 to be described hereinafter) have been designated by like reference numerals. Thus, the three links 70, 72 and 74 can be seen in FIGS. 3 and 4 along with the other components illustrated in FIGS. 2A–2C. Note specifically the connecting bar as coupling means 68 illustrated in FIGS. 2A and 2B correspond to a dual link, arrangement 68' including links 111 and 112 which are pivotally connected together at 114. One end of this double linkage is connected to link 70 by means of a pin 116 which rides within a slot 120 formed in link 70. The opposite free end 122 of the double linkage is pivotally connected to a rod 124 connected directly to previously recited movable contact 64 (not shown in FIG. 3) located within a breaker housing 126 which also contains previously recited stationary contact 62. As will be seen hereinafter in conjunction with FIG. 5, contacts 62 and 64 actually form one phase of a three-phase electrical circuit. Thus, the input and output terminals 128 and 130, respectively, shown in FIG. 3 correspond to terminals for one phase (Bϕ in FIG. 5) of the three-phase system. The other two phases (Aϕ and Cϕ) are connected to switch 66 through cooperating links 70A and 70C and cooperating cam rollers 116A and 116C in slots defined by links 70A and 70C, as shown in FIG. 5.

Still referring to FIG. 3, switching assembly 66 is shown in its closed position, as indicated previously. Note that the cam member 90 is mounted for pivotal movement clockwise about a pivoting pin mechanism 133 which is better illustrated in FIG. 5. Note also that the cam member 90 defines a cam surface extending from a radially inward hollow or radially inward space 134 counterclockwise around pivot pin mechanism 133 to a tail point 136 just above hollow 134. The three-link arrangement consisting of links 70, 72 and 74 are maintained in the previously described closed positional configuration by means of cam member 90. More specifically, the cam member is held in the position shown in FIG. 3 such that tail section 136 of the cam member urges link 72 upward in the manner described previously. The cam member is held in this position by means of a closing spring 140 which is mounted at one end to support pin 142 and at its opposite end to pin connecting 144 which is connected to rotating pin mechanism 133 by moment arm 145 shown in FIG. 5.

With switch assembly 66 in the positional configuration illustrated in FIG. 3, closing spring 140 is energized (compressed) so as to urge the cam member clockwise as indicated by arrow 94. However, the cam member carries a stop roller 146 which is engaged against a closing latch 148. Thus, the cam member 90 remains stationary, holding the three-link arrangement in a closed positional configuration. Note also that the opening spring 88 which is connected to the pivot means 84 of link 70 by means of eye lug 150 is in an energized state, that is, compressed. Thus, spring 88 wants to urge link 70 counterclockwise about pivot means 84, as indicated by arrow 106, as described previously, but is unable to do so because of the resistance by cam member 90 through link 72. It will also be recalled that link 74 is biased against latch 92. This was diagrammatically represented by the force F2 in FIG. 2A. In actuality, the spring force applied to link 70 by opening spring 88 is coupled to link 74 through link 72 urging link 74 in the direction of arrow 102 and therefore against latch 92.

Having described the switch assembly in its closed positional configuration, attention is now directed to the way in which the switch assembly is caused to move immediately to its opened positional configuration. As indicated previously, in conjunction with FIGS. 2A–2C, it is only necessary to rotate latch 92 in order to allow link 74 to pivot past the lever in the direction of arrow 102. The latch 92 can be rotated by moving pin mechanism 156 to the left, as indicated by arrow 160, utilizing an electromagnetic trip coil 162 illustrated in FIG. 5. This motion releases cam member 90, permitting it to move in the manner described. This in turn causes the three-link arrangement to move in the manner described above which, in turn, causes the free end 122 of dual link arrangement 68' corresponding to coupling means 68 to move upward, as indicated by arrow 166 in order to open contacts 62 and 64.

Referring now to FIG. 4, the switch assembly 66 is shown in its open positional configuration. For purposes of clarity, the contact housing 166 has been omitted. Note specifically that the free end 122 of dual link arrangement 68 is in a raised position with pin 116 disposed at the right-hand end of slot 120 in link 70. This link has rotated counterclockwise into engagement with a stop 170 which prevents it from further rotating. Also note that the link 74 and latch 92 have returned to their original FIG. 3 positions. This is caused by the return forces of the guide cam springs (205) and the trip shaft return spring (206). Moreover, while the opening spring 88 discharged during the opening process, it should be noted that the closing spring remains energized. In fact, it should be emphasized that throughout the process described immediately above, the cam member 90 did not move. However, the three-link arrangement moved away from the cam member 90 so as to allow the circuit breaker to open without any positive action by cam member 90 or its associated components.

With the foregoing comments in mind, attention is now directed to the way in which switch assembly 66 is moved to its closed operational configuration. Specifically, an electromagnetic solenoid 172 is coupled to closing latch 148 through linkage 174 for rotating the lever clockwise about support element 176, as indicated by arrows 178. This releases the restrained roller 146, in turn causing cam member 90 to rotate clockwise, as indicated by arrow 94 due to the force applied to connecting pin 144 (see FIG. 5) by closing spring 140. This causes roller 96 to move upward on the cam surface of cam member 90 within slot 82 of link 74 as the cam member rotates clockwise. As it does so, it moves link 72 upward in the direction of arrow 98 and causes link 70 to pivot clockwise about pivot means 84, as indicated by arrow 100, so as to drive free end 122 of dual link arrangement 68' downward, thereby closing the contacts. Ultimately it is the closing spring 140 that is responsible for closing the switch assembly 66 by causing cam member 90 to rotate 180° placing pin 144 180° above where it is illustrated in FIGS. 3 and 4. At the same time, the closing spring de-energizes (moves into a relaxed state) and the opening spring is again energized, as shown in FIG. 3.

It is important to note that during the rotating process of cam member 90 from its FIG. 4 position to a position 180° clockwise in order to close the switch assembly, link 74 remains stationary, held in place by means of latch 92. At any time during this process, the closing action of the switch assembly can be interrupted and the assembly can be immediately opened merely by energizing solenoid 162 and causing pin mechanism 14 to rotate the latch 92 in order to free link 74 so that the latter and cam roller 96 move away from the cam member 90. This in turn causes the three links to collapse in the manner described previously in order to open the switch assembly and therefore the contacts 62 and 64. This occurs even though the cam member may still be rotating clockwise from its FIG. 4 position to a position 180° therefrom. This is because tripping link 74 in the manner just described pulls the entire link arrangement away from cam member 90.

As indicated above, power from closing spring 140 is used to close switch assembly 66 and therefore the overall circuit breaker. As also stated immediately above, this places cam member 90 180° clockwise with respect to the position shown in FIG. 4. In order to close the contacts a second time after they have been opened in the manner described, it is necessary to re-energize spring 140. This is accomplished by means of a suitable motor 180 illustrated in FIG. 5 and a mechanism generally indicated at 182 coupling the motor to cam member 90. More specifically, the motor 180 is used to rotate the cam member an additional 180° clockwise until it is again in the position illustrated in FIG. 3. This in turn causes connecting pin 144 to move back to its lowered position, compressing (energizing) the closing spring 140. Since the latter is to the left of the toggle defined by the overall switch assembly, it urges the cam member clockwise, as described previously. However, stop roller 146 again rests against closing latch 148 in order to hold the cam member in place.

FIG. 5 illustrates the overall switch assembly 166 in front elevational view. Inasmuch as the present invention resides in the three-link arrangement which was described in detail in the earlier drawings and not necessarily the associated components, these components will not be further described herein. It suffices to illustrate them in FIG. 5 in conjunction with the other figures. It also suffices to say that the links themselves are actually formed as two bar links. For example in FIG. 5, note that link 74 is actually comprised of two spaced-apart link bars as is link 72 and link 70. Note also that the pivot means 84, actually an elongated bar, extends all the way across link 70 and joins two additional mechanisms 116A and 116C for use in a three-phase system.

What is claimed is:

1. An operating mechanism for use in a switch assembly including switch means movable between an opened condition and a closed condition, said mechanism comprising:

(a) a linkage arrangement including (i) a first, tripping link and means supporting said tripping link for movement between a first, non-tripping position and a second, switch-tripping position, (ii) a second link and means connecting said second link directly to said first link for sliding movement relative to said first link along a lengthwise path from a first, switch-opening position to a second, switch-closing position, so long as said tripping link remains in its non-tripping position, and (iii) means connecting said second link with said switch means for moving the latter between its opened and closed conditions when said second link moves between its switch-opening and switch-closing positions, said last-mentioned connecting means also biasing said second link in its switch-opening position;

(b) means for applying a sufficient force directly to said second link when said tripping link is in its non-tripping position to slideably move said second link from its biased switch-opening position to its switch-closing position and for maintaining the second link in this latter position, whereby to move said switch means from its opened condition to its closed condition and maintain the switch in this latter position;

(c) means for moving said tripping link between its non-tripping and switch-tripping positions at any time during operating of said switch assembly; and (d) said first and second links being connected together such that movement of said first link from its non-tripping position to its tripping position automatically causes said second link to move to its biased switch opening position whether said second link is at its switch-closing position or moving towards this latter position.

2. A mechanism according to claim 1 wherein said tripping link includes an elongated slot and wherein said means connecting said second link to said tripping link includes cam means connected with said second link and mounted for movement within and along said elongated slot, whereby to guide said second link as the latter moves between its switch-opening and switch-closing positions.

3. A mechanism according to claim 1 wherein said means for applying force to said second link includes cam means engaging said second link and wherein said tripping and second links are connected together such that movement of said tripping link from its non-tripping position to its switch-tripping position disengages said cam means from said second link, whereby to remove said force from said second link and cause the latter to move to its biased switching-opening position.

4. A mechanism according to claim 1 wherein said means connecting said second link with said switch means includes a third link connected with said second link for pivotal movement about a fixed axis between its own switch-opening and switching-closing positions simultaneous with and as a result of said movement of said second link, and means for spring biasing said second and third links in their respective switch-opening positions.

5. A mechanism according to claim 1 wherein said means supporting said tripping link includes means for pivotally supporting said tripping link for pivotal movement about a fixed axis between its non-tripping and switch-tripping positions and wherein said means for moving said tripping link includes means for biasing said tripping link in its switch-tripping position and means for removably retaining said tripping link in its second position.

6. A switch assembly, comprising:

(a) switch means movable between an opened condition and a closed condition;

(b) a first, tripping link having an elongated slot and means supporting said tripping link for pivotal movement about a first fixed axis between a non-tripping position and a switch-tripping position;

(c) a second link including cam means engaged within the slot in said tripping link for connecting said second link to said tripping link for sliding movement of the second link relative to the tripping link along a lengthwise path from a first, switch-opening position to a second, switch-closing position, so long as said tripping link remains in its non-tripping position;

(d) a third link connected to said second link for pivotal movement about a second fixed axis between its own switch-opening and switch-closing positions simultaneously with and as a result of the movement of said second link between its switch-opening and switch-closing positions, said third link being connected with said switching means for moving the latter between its opened and closed conditions when said second and third links move between their respective switch-opening and switch-closing positions;

(e) means for biasing said second and third links in their respective switch-opening positions;

(f) cam means for applying a sufficient force to said second link when said tripping link is in its non-tripping position to slideably move said second link from its biased switch-opening position to its switch-closing position and for maintaining the second link in this latter position, whereby to move said third link from its switch-opening position to its switch switch-closing position and thereby move said switch means from its opened condition to its closed position and to maintain the switch means in this latter position;

(g) means for biasing said first link in its tripping position;

(h) means for removable retaining said first-link in its non-tripping position; and (i) said tripping and second links being connected together such that movement of said tripping link from its non-tripping position to its tripping position automatically causes said second link to disengage from said force applying cam means, whereby to remove the force applied to said second link by said cam means and thereby cause said second link to automatically move to its biased switch-opening position, whether said second link is at its switch-closing position or moving toward this latter position.

* * * * *